United States Patent [19]

Scott

[11] 4,436,642

[45] Mar. 13, 1984

[54] NONIONIC SURFACTANTS FOR AUTOMATIC DISHWASHER DETERGENTS

[75] Inventor: Robert J. Scott, New City, N.Y.

[73] Assignee: Union Carbide Corporation, Danbury, Conn.

[21] Appl. No.: 349,597

[22] Filed: Feb. 17, 1982

[51] Int. Cl.[3] ..... C11D 1/70; C11D 3/075; C11D 3/395

[52] U.S. Cl. ..... 252/95; 252/99; 252/102; 252/174.21; 252/186.35; 252/DIG. 1; 568/608

[58] Field of Search ..... 568/608; 252/99, 135, 252/174.21, DIG. 1, 95, 102, 186.35

[56] References Cited

U.S. PATENT DOCUMENTS

| | | | |
|---|---|---|---|
| 2,677,700 | 5/1954 | Jackson et al. . | |
| 2,903,486 | 9/1959 | Brown et al. . | |
| 2,915,559 | 12/1959 | Horsley et al. . | |
| 3,021,372 | 2/1962 | Dupre | 568/608 |
| 3,314,891 | 4/1967 | Schmolka et al. . | |
| 3,969,134 | 7/1976 | Batka | 252/351 |
| 4,252,528 | 2/1981 | Deceker et al. . | |
| 4,272,394 | 6/1981 | Kaneko . | |
| 4,280,919 | 7/1981 | Stoeckigt | 252/135 |
| 4,349,448 | 9/1982 | Steele | 252/135 |

FOREIGN PATENT DOCUMENTS

| | | | |
|---|---|---|---|
| 652762 | 11/1962 | Canada | 252/DIG. 1 |
| 922252 | 3/1963 | United Kingdom | 252/DIG. 1 |
| 930933 | 7/1963 | United Kingdom | 568/608 |

*Primary Examiner*—Dennis L. Albrecht
*Attorney, Agent, or Firm*—Jean B. Mauro

[57] ABSTRACT

Nonionic surfactants, for automatic dishwasher detergents, provide enhanced low-foaming and wetting, and compatibility with active chlorine compounds. The surfactants are specific block oxypropylene/oxyethylene adducts of alkylphenols.

4 Claims, No Drawings

NONIONIC SURFACTANTS FOR AUTOMATIC DISHWASHER DETERGENTS

BACKGROUND OF THE INVENTION

1. Field of the Invention

This invention relates to automatic dishwasher detergent compositions containing low-foaming nonionic surfactants.

2. Description of the Prior Art

Detergent compositions containing, in combination, alkaline salts such as sodium silicate and sodium carbonate, an alkaline polyphosphate such as sodium tripolyphosphate, a low-foaming, chlorine-compatible nonionic surfactant, and a chlorine containing compound that provides a hydrochorite ion in solution are well known and have particular utility in machine dishwashing.

There are many different views on how dishwashing detergents function, but there seems to be general agreement on several points, to wit: 1. The main cleaning is done by the alkaline salts whether by emulsification, saponification, sequestering hard water ions and/or other mechanisms; 2. the active chlorine compound is aimed principally at protein soil but also serves as a destainer and germicide; 3. solubilized protein soil is a main cause of foaming problems; and 4. the surfactant provides optimum cleaning and good spotting and filming results while also providing defoaming power in the presence of foam producing food soil, but the use of auxiliary foam depressants is generally preferred to achieve optimum foam suppressing characteristics. Thus, while dishwasher detergents may clean by a number of processes, the combination of requirements for surfactants that are employed in such detergent compositions are well established. The surfactant must be low foaming and be capable of defoaming food soils; it must have a low cloud point (generally less than about 30° C.) so that it can function as a foam suppressor by separating from solution under hot water temperature (e.g. about 60° C.) but at the same time be sufficiently soluble in the wash liquor to provide wetting; it must be compatible with active chlorine and not markedly decompose those chlorinated compounds used in detergent compositions; and it must have good wetting characteristics to give good spotting and filming results.

A wide variety of nonionic surfactants have been disclosed as useful in automatic dishwasher detergent compositions. Broad disclosures of block oxypropylene/oxyethylene adducts of alcohols have been described, for example, in U.S. Pat. No. 3,314,891 (Schmolka et al.) and U.S. Pat. No. 4,272,394 (Kaneko). These patents, however, do not disclose the particular nonionic surfactant structures claimed in the present invention. In contrast, the prior art contains disclosures, such as in U.S. Pat. No. 2,903,486 (Brown et al.), suggesting that oxyalkylene adducts of alkylphenols having block oxypropylene/oxyethylene groups with the oxypropylene groups proximate to the alkylphenoxylate would be undesirable.

A specific nonionic surfactant structure useful in the automatic dishwasher detergent composition of the present invention, has been disclosed in U.S. Pat. No. 4,252,528 (Decker et al.). This patent, however, relates to lubricant compositions for finishing synthetic fibers.

SUMMARY OF THE INVENTION

In accordance with the present invention there is provided an automatic dishwasher detergent composition comprising a nonionic surfactant of the formula:

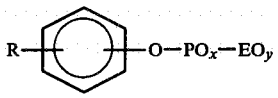

wherein R is an alkyl group containing from 6 to about 12 carbon atoms, preferably from 8 to 10, and most preferably 9; PO is an oxypropylene group; x is from about 6 to about 15, preferably from about 8 to about 14; EO is an oxyethylene group; and y is from about 4 to about 10, and preferably from about 4 to about 6.

It has been discovered that the nonionic surfactants used in the invention are compatible with active chlorine, exhibit good low-foaming and foam suppressing characteristics. These surfactants minimize the need for using auxiliary foam suppressors in compositions exhibiting foaming, such as automatic dishwasher detergents, and also provide enhanced wetting characteristics compared to nonionic surfactants employed commercially in dishwasher detergent compositions, thus giving improved spotting and filming results.

There is also provided in accordance with the present invention automatic dishwasher detergent compositions, and method for their use, comprising:

(a) from about 10 weight percent to about 90 weight percent, preferably about 20 weight percent to about 70 weight percent, detergency builder (b) from about 0.5 weight percent to about 10 weight percent, preferably about 1 weight percent to about 3 weight percent, of an active chlorine containing compound; and (c) from about 1 weight percent to about 15 weight percent, preferably about 2 weight percent to about 10 weight percent, of the above-described nonionic surfactant.

DETAILED DESCRIPTION OF THE INVENTION

The low-foaming, chlorine-compatible nonionic surfactants used in the present invention, having superior wetting characteristics and enhanced foam suppressing power in the presence of foam-producing food soils, are condensate products of specific alkylphenols with a particular block oxypropylene/oxyethylene molecular structure. The automatic dishwasher detergent compositions of this invention contain nonionic surfactants which may be represented by the formula:

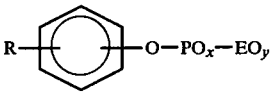

wherein R is an alkyl group having from 6 to about 12, carbon atoms, preferably from 8 to 10, and most preferably 9; PO is an oxypropylene group; x is from about 6 to about 15, preferably about 8 to about 14; EO is an oxyethylene group; and y is from about 4 to about 10, and preferably from about 4 to about 6. The alkylphenoxylate in the foregoing formula may also be defined as the residue of the alkylphenol employed in the condensation reaction to produce the condensate, i.e., the alkylphenol with the hydrogen in the OH radical removed.

The nonionic surfactants of this invention can be prepared according to the examples and procedures set forth in U.S. Pat. No. 4,252,528 (Decker et al.), which is incorporated herein by reference, by reacting an alkylphenol, having an alkyl group with from 6 to about 12, preferably from 8 to 10, and most preferably 9, carbon atoms, with from about 6 to about 15, preferably from 8 to about 14, moles of propylene oxide to form a block molecular structure. This adduct can then be reacted with from about 4 to about 10, and preferably from about 4 to about 6, moles of ethylene oxide to prepare the block oxypropylene/oxyethylene nonionic surfactants of the present invention. It has been surprisingly and unexpectedly found that these surfactant structures produce automatic dishwasher detergent compositions having enhanced chlorine compatibility along with a desired combination and balance of low-foaming, foam suppressing, and superior wetting properties.

Alkylphenols which may be employed in preparing the surfactants include those having primary, straight- and branched-chained alkyl groups containing from 6 to about 12, preferably from 8 to 10, and most preferably 9 carbon atoms. Exemplary suitable alkylphenols are octyl, nonyl, and decyl phenols and mixtures thereof. A particularly preferred alkylphenol is nonylphenol.

The surfactants of the present invention are prepared by condensing an alkylphenol as described herein with propylene oxide and then ethylene oxide in two distinct steps. In the first step, propylene oxide is added to the alcohol and the condensation reaction is carried out generally in the presence of an alkaline catalyst. Catalysts which may be employed include sodium hydroxide, potassium hydroxide, sodium acetate and preferably an alkali metal alcoholate of the alcohol. Any other type of catalysts commonly used for alkylene oxide addition reactions with reactive hydrogen compounds may also be employed. After the condensation reaction in the first step is completed, ethylene oxide is added to the reaction mixture from the first step until a product having the desired cloud point is obtained. No additional catalyst is usually required to carry out the second step of the reaction. The condensation reaction in both the first and second steps are preferably carried out at elevated temperatures and pressures. After the condensation reaction is completed, the catalyst is removed from the reaction mixture by any known procedure such as neutralization and filtration or ion exchange.

The nonionic surfactants herein described exhibit the combination and balance of low-foaming, foam suppressing, superior wetting and chlorine compatibility required for automatic dishwasher detergent compositions and, in fact, are useful in preparing such compositions which exhibit superior spotting and filming properties.

The automatic dishwashing detergent compositions provided in accordance with this invention comprise;

1. from about 10 weight percent to about 90 weight percent, and preferably from about 20 weight percent to about 70 weight percent of the composition, of a detergency builder;

2. from about 0.5 weight percent to about 10 weight percent, and preferably from about 1 weight percent to about 3 weight percent of the composition, of a chlorine-containing compound; and 3. from about 1 weight percent to about 15 weight percent, and preferably from about 2 weight percent to about 10 weight percent of the composition, of the herein described low-foaming nonionic surfactant.

The detergency builder can be any of the known detergent builders, as described, for example, in U.S. Pat. No. 3,936,386 (Corliss et al.), U.S. Pat. No. 4,188,305, (Halas) and U.S. Pat. No. 4,306,987 (Kaneko). Suitable builders include trisodium phosphate, tetrasodium pyrophosphate, sodium acid pyrophosphate, sodium tripolyphosphate, sodium hexametaphosphate, sodium silicates having $SiO_2$:$Na_2O$ ratios of from about 1:1 to about 3.6:1, sodium carbonate, sodium hydroxide, sodium citrate, borax, sodium ethylene diaminetetraacetate, sodium nitrilotriacetate, sodium carboxy/methyloxysuccinate, and mixtures thereof. Although the sodium salts are the most commonly used, potassium, ammonium, and substituted ammonium (e.g. methyl, monoethanol, diethanol and triethanol ammonium) salts can be substituted. Other suitable builder salts are well known and disclosed in the prior art. Compositions of the invention will contain from about 10 weight percent to about 90 weight percent, and preferably from about 20 weight percent to about 70 weight percent of such builders.

Chlorine-containing compounds suitable for use in compositons of the invention are chlorine bleach compounds which contain chlorine in active form. The term active chlorine compound includes compounds which increase detergency primarily by solubilizing protein soil by releasing a chlorine agent into a detergent solution. Such compounds are often characterized as hypochlorite compounds which are well known as a class. Exemplary suitable chlorine-containing compounds are chlorinated trisodium phosphate, sodium and potassium dichlorocyanurates; dichlorocyanuric acid; 1,3-dichloro-5,5-dimethyl hydantoin, N,N'-dichlorobenzoylene urea; paratoluene sulfondichloroamide; trichloromelamine; N-chloroammeline; N-chlorosuccamide; N,N'-dichloroazodicarbonamide; N-chloroacetyl urea; N,N'-dichlorobiuret; chlorinated dicyandiamide; sodium hypochlorite; calcium hypochlorite; and lithium hypochlorite. Compositions of the invention should contain from about 0.5 weight percent to about 10 weight percent, and preferably from about 1 weight percent to about 3 weight percent, of such chlorine-containing compounds. Such compounds should have a source of available chlorine in an amount sufficient to provide available chlorine equal to about 0.5 weight percent to about 10 weight percent by weight of the composition.

The nonionic surfactant component of the automatic dishwashing detergent compositions of the invention are the low-foaming nonionic surfactants of the invention which are the condensate products of an alkylphenol having the particular block oxypropylene/oxyethylene molecular structure hereinabove described. It has been found that from about 1 weight percent to about 15 weight percent of said low-foaming surfactant, based on the total weight of the composition, should be used to provide optimum cleansing, spotting and filming characteristics. A preferred amount of surfactant is from about 2 weight percent to about 10 weight percent of the composition.

While it is not essential, in addition to the essential components herein above described it may be desirable to incorporate an auxilliary foam-suppressor or defoaming agent in the dishwasher detergent compositions to provide an even further reduction in the foaming tendency of aqueous solutions thereof, particularly in the presence of proteinaceous food residues. Suitable auxilliary foam-suppressors include long chain fatty acids such as behenic acid (available commercially under the trade name "Hystrene 9022" from Humko Div., Witco Chemical Co.) and alkyl phosphate esters containing 16 or more carbon atoms in the alkyl radical, such as hexadecyl acid phosphate, and the salts thereof. Other suitable foam-suppressors are well known and disclosed in the prior art.

In addition to the above ingredients it is understood that additional ingredients may be present such as fillers e.g. sucrose, sucrose esters, sodium chloride, sodium sulfate etc. in amounts from about 0.001% to about 60%; china protecting agents including alumino-silicates, aluminates, etc. in amounts from about 0.1% to about 5%; hydrotrope materials including sodium benzene, sodium toluene sulfonate, etc. in minor amounts; dyes; perfumes; crystal modifiers and the like can also be present in minor amounts.

The dishwasher detergent compositions of the invention may be formulated by known dry-blending or agglomeration techniques. In dry-blending the prepulverized components are merely mixed together, as by tumbling, to form the final product. In agglomeration, a specialized mixing technique is employed wherein, for example, the thoroughly commingled dry components are wetted in a controlled manner with the nonionic surfactant and silicate builder in solution form while the mass is thoroughly stirred. The resulting product is a free-flowing granular product.

EXAMPLES

The following Examples illustrate the enhanced utility of the automatic dishwasher detergent composition of the present invention. The designations used in the Examples are defined as follows, wherein NP is nonylphenyl; PO is oxypropylene and EO is oxyethylene:

| Designation | Description |
|---|---|
| Comparative Surfactant I | A butyl capped 12 mole ethoxylate of isooctylphenol distributed under the tradename TRITON CF-54 by Rohm and Haas Co. |
| Comparative Surfactant II | An oxyalkylene adduct of linear $C_{15(average)}$ primary alcohols having a random mixture of 5 and 7 moles of oxypropylene and oxyethylene, respectively, distributed under the tradename PLURAFAC RA-40 by BASF Wyandotte Corporation. |
| Surfactant I | NP-8PO/6EO, i.e., a block oxyalkylene adduct of nonylphenol having 8 and 6 moles of oxypropylene and oxyethylene respectively. |
| Surfactant II | NP-10PO/5EO |
| Surfactant III | NP-12PO/4EO |

EXAMPLE 1

This Example demonstrates the superior chlorine compatibility exhibited by the automatic dishwasher compositions of the present invention, identified as Surfactant I, II and III in Table 1 below, as compared with a standard, commercially available, chlorine stable surfactant known to those skilled in the art. The test conditions comprised placing samples containing 5 weight percent surfactant, 5 weight percent sodium dichloroisocyanurate, an active chlorine-containing compound, and 90 weight percent sodium tripolyphosphate, in an incubator at around 37° C. and at a relative humidity of 70 percent. Chlorine content was measured at the beginning and end, after three weeks, by iodometric titration.

TABLE 1

Chlorine Stability Tests

| Surfactant | Cloud Point | Remaining Chlorine, % |
|---|---|---|
| Surfactant I | 22 | 55 |
| Surfactant II | 16 | 55 |
| Surfactant III | 20 | 85 |
| Comparative Surfactant I | 38 | 46 |

EXAMPLE 2

This Example demonstrates the superior low-foaming properties exhibited by the automatic dishwasher detergent compositions of the present invention, as compared with a commercially available standard. The test procedure followed CSMA Test DCC-01 using a formulation containing 2 weight percent surfactant, 33 weight percent sodium metasilicate.$5H_2O$, 32 weight percent sodium carbonate with theremainder detergency builder. The results are set forth in Table 2 below. Defoaming is measured by obtaining the ratio of rotor speed with detergent and soil present divided by the ratio of the rotor speed with water alone, times 100. Higher ratios are more desirable as indicating lower foam formation.

TABLE 2

Machine Defoaming Tests

| Surfactant | Ratio, % |
|---|---|
| Surfactant I | 42 |
| Surfactant II | 50 |
| Surfactant III | 53 |
| Comparative Surfactant II | 45 |

The results indicate that the detergent compositions of the present invention are comparable and superior to a commercial standard.

EXAMPLE 3

This Example demonstrates the superior wetting properties exhibited by the automatic dishwasher detergent compositions of the present invention. The test results, set forth in Table 3 below are based on CSMA Test DCC-05, using a formulation of 2 weight percent surfactant, 33 weight percent sodium silicate.$5H_2O$, 15 weight percent sodium carbonate, 28 weight percent sodium sulphate, 20 weight percent sodium tripolyphosphate and 2 weight percent sodium dichloroisocyanurate. The rating scale is as follows:

1 = glass spotless
2 = spots at random or barely perceptible film
3 = ¼ of glass covered with spots or film 4 = ½ of glass covered with spots or film 5 = glass completely covered with spots or film

TABLE 3

| Spotting and Filming Tests | | | | |
|---|---|---|---|---|
| Test Cycle | Surfactant I | Surfactant II | Comparative Surfactant III | Comparative Surfactant II |
| 1 | 1.5 | 1.3 | 1.3 | 2.0 |
| 2 | 1.4 | 1.3 | 1.8 | 2.1 |
| 3 | 1.5 | 1.6 | 2.0 | 2.5 |
| 4 | 1.5 | 2.4 | 2.6 | 2.5 |
| 5 | 2.0 | 2.4 | 3.0 | 4.0 |
| 6 | 1.8 | 3.0 | 3.3 | 3.6 |
| 7 | 2.0 | 2.8 | 3.3 | 3.6 |
| 8 | 2.5 | 2.8 | 3.9 | 3.7 |
| 9 | 2.5 | 2.8 | 3.0 | 3.9 |
| 10 | 2.6 | 2.8 | 3.0 | 4.0 |
| Average | 2.0 | 2.3 | 2.7 | 3.2 |

The automatic dishwasher detergents of the present invention all showed better wetting, i.e., lower spotting and filming, than the commercially available standards.

EXAMPLE 4

This Example demonstrates the use as a preferred auxilliary defoamant, hexadecyl acid phosphate. The hexadecyl acid phosphate was produced by reacting 30.0 grams of hexadecyl alcohol with 100 milliliters of n-hexane by heating the reactants in the presence of polyphosphoric acid for six hours. Using similar test procedures as those described in Examples 1–3 above, an automatic dishwashing detergent containing Surfactant I with 5 percent hexadecyl acid phosphate as auxilliary defoamant, gave an average spotting and filming test value of 2.7, and a chlorine retention value of 40 percent. The defoaming efficiency was determined using varying levels of hexadecyl acid phosphate concentration as set forth in Table 4 below:

TABLE 4

| Defoaming Test | |
|---|---|
| Hexadecyl Acid Phosphate, Concentration, % | Rotor Speed Ratio, % |
| 0.0 | 41 |
| 1.5 | 49 |

TABLE 4-continued

| Defoaming Test | |
|---|---|
| Hexadecyl Acid Phosphate, Concentration, % | Rotor Speed Ratio, % |
| 3.0 | 66 |
| 5.0 | 75 |

I claim:

1. An automatic dishwasher detergent comprising:
(a) from about 10 weight percent to about 90 weight percent of a detergency builder;
(b) from about 0.5 weight percent to about 10 weight percent of an active chlorine containing compound; and
(c) from about 1 weight percent to about 15 weight percent of a nonionic surfactant of the formula

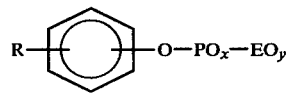

wherein R is a nonyl group, x is 12 and y is 4.

2. The detergent of claim 1 consisting essentially of:
(a) from about 20 weight percent to about 70 weight percent of said detergency builder;
(b) from about 1 weight percent to about 3 weight percent of said active chlorine containing compound; and
(c) from about 2 weight percent to about 10 weight percent of said nonionic surfactant.

3. The detergent of claim 1 in an aqueous solution.

4. A method of washing dishes comprising contacting dishes in an automatic dishwasher with a detergent comprising a nonionic surfactant of the formula:

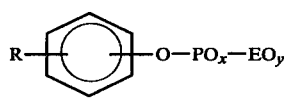

wherein R is a nonyl group; PO is an oxypropylene group; x is 12; EO is an oxyethylene group; and y is 4, said detergent containing an active chlorine-containing compound and exhibiting low-foaming, superior wetting and scouring, and chlorine compatibility.

* * * * *